US007090118B2

(12) United States Patent
Lackey et al.

(10) Patent No.: US 7,090,118 B2
(45) Date of Patent: Aug. 15, 2006

(54) MAILBOX AND SUPPORT

(76) Inventors: Robert W. Lackey, 840 8th St., NW., Hickory, NC (US) 28601; Robert C. Beckmann, 6314 Providence Church Rd., Vail, NC (US) 28168

( * ) Notice: Subject to any disclaimer, the term of this patent is extended or adjusted under 35 U.S.C. 154(b) by 0 days.

(21) Appl. No.: 11/032,964

(22) Filed: Jan. 11, 2005

(65) Prior Publication Data

US 2006/0151589 A1 Jul. 13, 2006

(51) Int. Cl.
*A47G 29/12* (2006.01)

(52) U.S. Cl. ..... 232/39; 248/146; 248/151; 248/159

(58) Field of Classification Search ..... 232/39, 232/17, 16; D99/29, 32; 248/146, 150, 248/151, 219.2, 156, 159
See application file for complete search history.

(56) References Cited

U.S. PATENT DOCUMENTS 4,403,730 A * 9/1983 Batson ..... 232/39
4,416,414 A * 11/1983 Edgerton ..... 232/39
5,060,908 A * 10/1991 Sofy ..... 248/545
5,465,902 A * 11/1995 Hanson ..... 232/33
5,664,729 A * 9/1997 Ladewig ..... 232/39
D385,680 S * 10/1997 Cacciola et al. ..... D99/29
6,161,756 A * 12/2000 Upton ..... 232/39
6,474,543 B1 * 11/2002 Grell ..... 232/38
6,543,680 B1 * 4/2003 McCormack ..... 232/39
D488,908 S * 4/2004 Hradisky ..... D99/29
D489,159 S * 4/2004 Hradisky ..... D99/29
D489,160 S * 4/2004 Hradisky ..... D99/29
6,722,561 B1 * 4/2004 Thomas et al. ..... 232/39
6,736,310 B1 * 5/2004 Mesol ..... 232/39
D497,465 S * 10/2004 Hradisky ..... D99/29

* cited by examiner

*Primary Examiner*—William L. Miller
(74) *Attorney, Agent, or Firm*—Charles L. Schwab; Nexsen Pruet, LLC

(57) ABSTRACT

A mailbox is secured to a support by a tongue and groove connection. The support may be formed of two side by side pieces, which are maintained in assembly by the tongue and grove connection. The two pieces of the support may have mating protrusions and pockets preventing sideway displacement of the support pieces from one another.

8 Claims, 5 Drawing Sheets

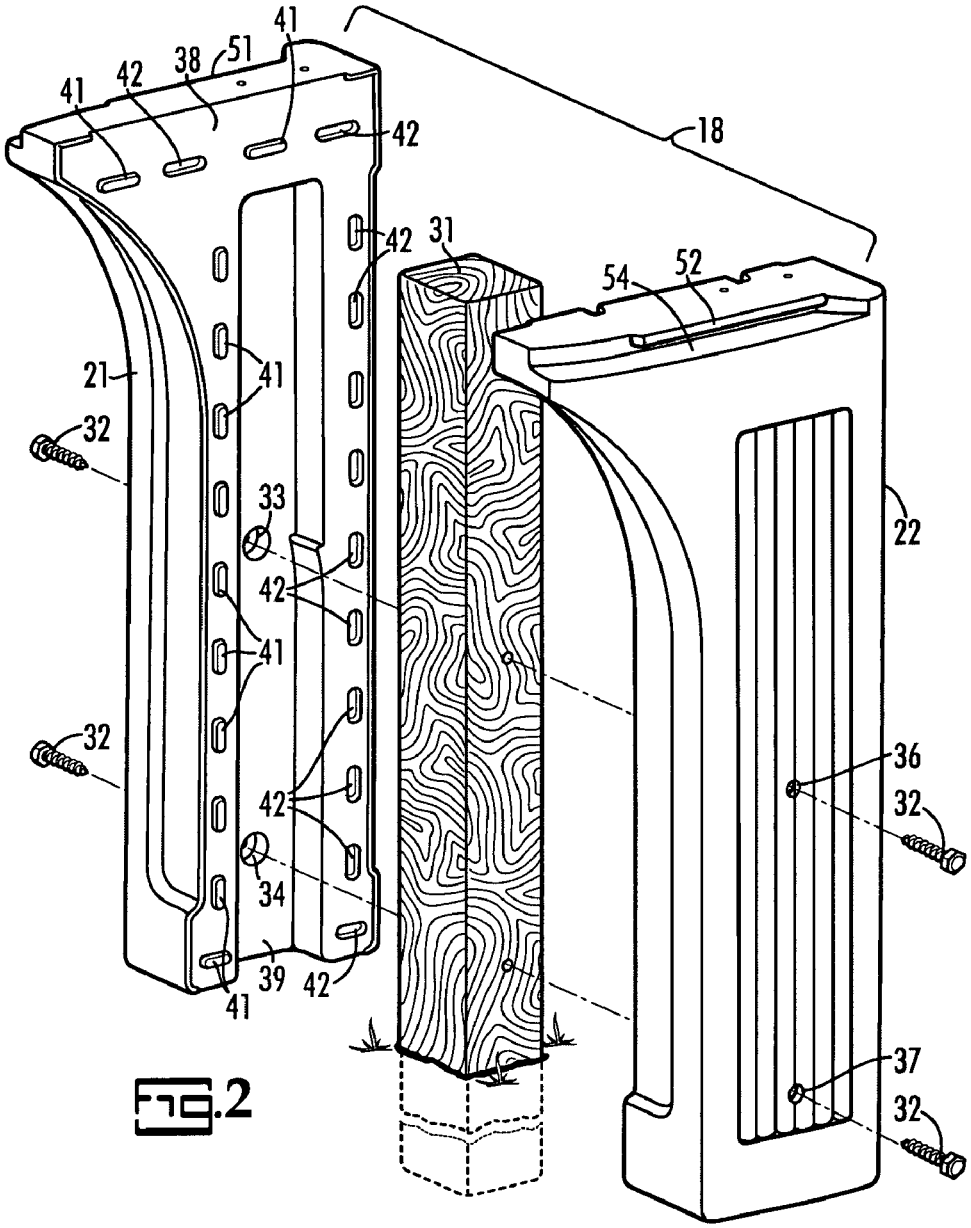
FIG. 2
FIG. 3
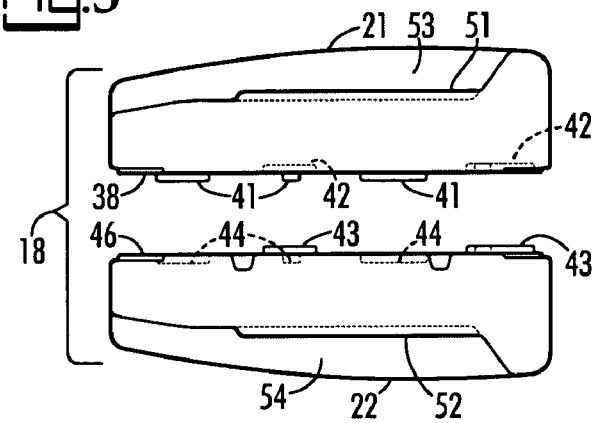

MAILBOX AND SUPPORT

BACKGROUND OF THE INVENTION

Rural mailboxes positioned on the side of roads are exposed to weather conditions, road maintenance work and vandalism. Plastic mailboxes are increasingly favored because they are relatively sturdy, maintain a good appearance over time and resist accidental and deliberate damage. Such plastic mailboxes may include a postal box, a newspaper box and a vertical support, which attaches to a post installed in the ground.

BRIEF DESCRIPTION OF THE INVENTION

A plastic mailbox structure has a mailbox, which includes a letterbox and a newspaper box. The letterbox is releasable secured to a two-piece plastic support having a hollow interior for encasing a vertical support post installed in the ground. The underside of the newspaper box and the top of the two-piece support have a tongue and a groove connection and releasable fasteners securing the newspaper box to the two halves of the support. The tiered mailbox structure is made up of molded components, which can be manufactured at a reasonable cost; are easy to assemble, provide a sturdy construction and have a long service life.

BRIEF DESCRIPTION OF THE DRAWINGS

One embodiment of the invention is illustrated in the accompanying drawings, in which:

FIG. 2 is a perspective view of the support showing its two pieces exploded from a wooden post;

FIG. 3 is a top view of the two-piece support with the two pieces separated to show interlocking parts;

DETAILED DESCRIPTION OF THE INVENTION

Figure 1:
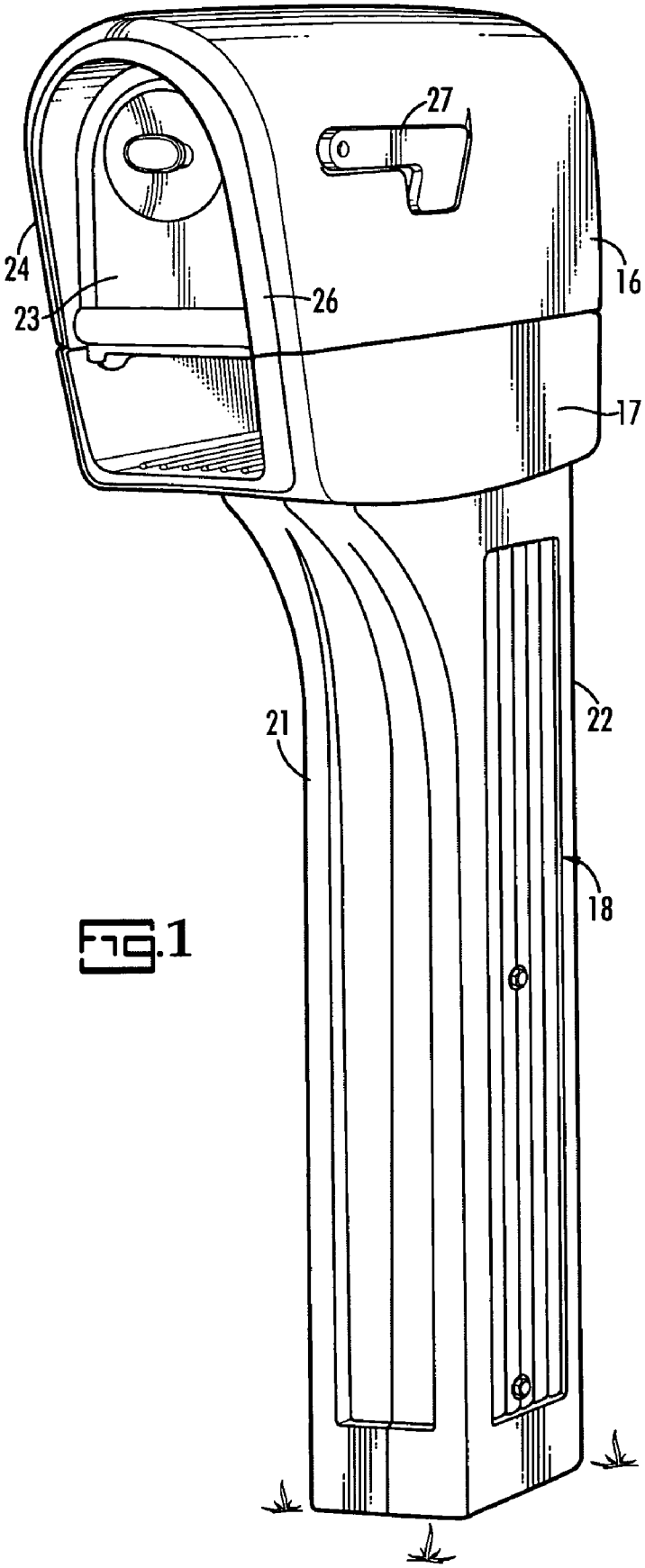
FIG. 1 is a perspective view of a mailbox structure.

The plastic mailbox structure shown in FIG. 1 includes mailbox, made up of a postal or letter box 16 and a newspaper box 17, and a vertical support 18 formed by two halves or pieces 21, 22. The postal box 16 includes a door 23 hinged at its lower corners to the sidewalls 24, 26 of the postal box 16 and a flag 27 or signal pivotally connected to the sidewall 26.

Figure 9:
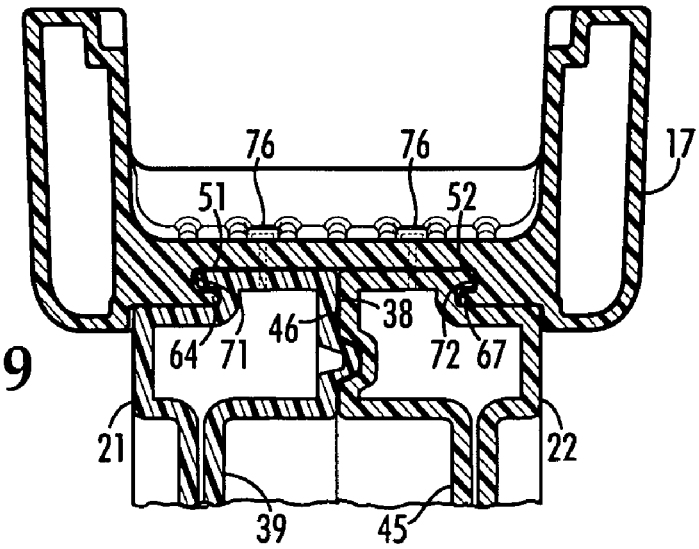
FIG. 9 is a section taken on the line 9—9 in FIG. 5.
Figure 6:
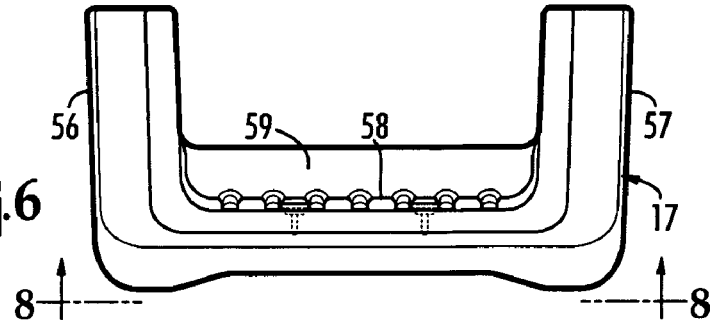
FIG. 6 is a front view of the newspaper box.
Figure 7:
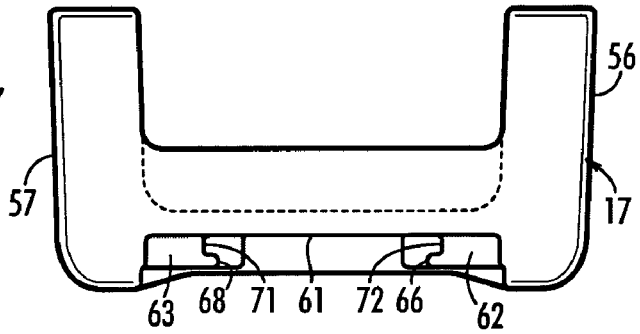
FIG. 7 is a rear view of the newspaper box.
Figure 8:
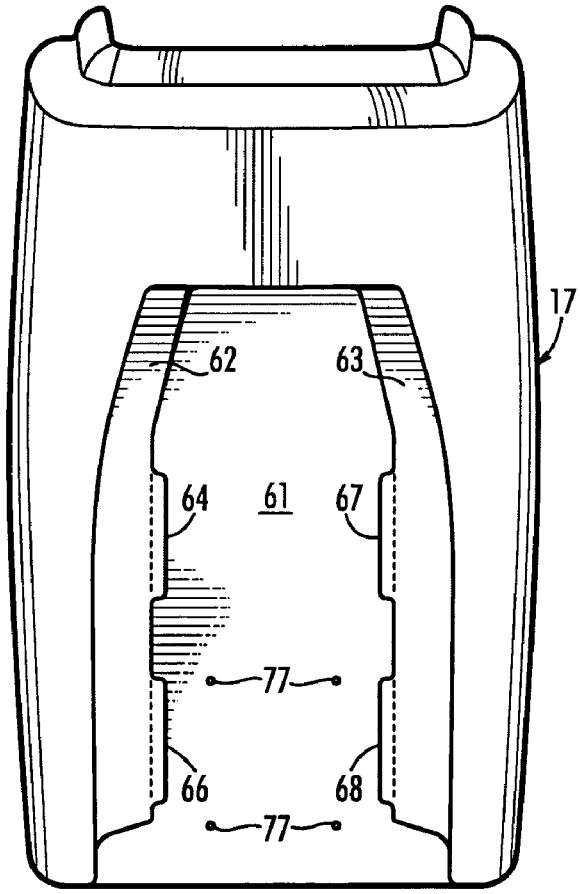
FIG. 8 is a bottom view of the newspaper box taken on line 8—8 in FIG. 6.

In the exploded view of FIG. 2, the two vertical pieces 21, 22 of the support 18 are shown removed from a square section wooden post 31 installed in the ground. Mounting screws 32 are shown removed from the openings 33, 34, 36, 37 in the pieces 21, 22 and from the post 31. Referring also to FIG. 9, the inward facing side 38 of the piece 21 has a vertical channel 39 extending upwardly from its bottom to near its top. Likewise a vertical channel 45 is formed in the inward facing side 46 of the piece 22. Comparably sized protrusions 41 and pockets 42 are formed on the inward facing side 38 of the piece 21. As shown in FIG. 3, protrusions 43 and pockets 44 are provided on the inward facing side 46 of the piece 22 which mate with the protrusions 41 and the pockets 42 of the piece 21. Thus the protrusions and pockets function as interlocking parts when the pieces 21, 22 are secured to the post 31 by the screws 32.

Figure 4:
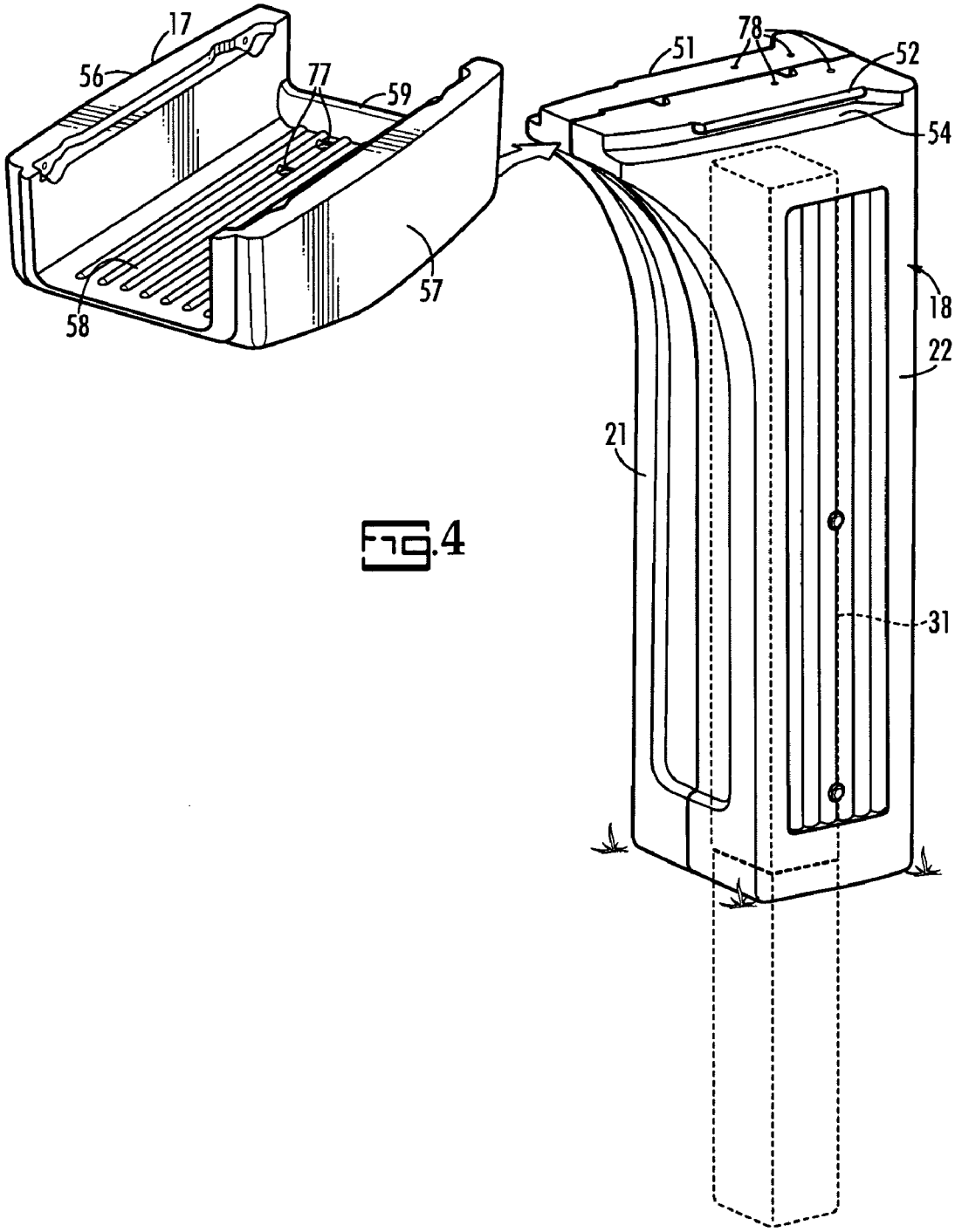
FIG. 4 is a perspective view of the support installed on a post and the newspaper box positioned for installation on the support.
Figure 5:
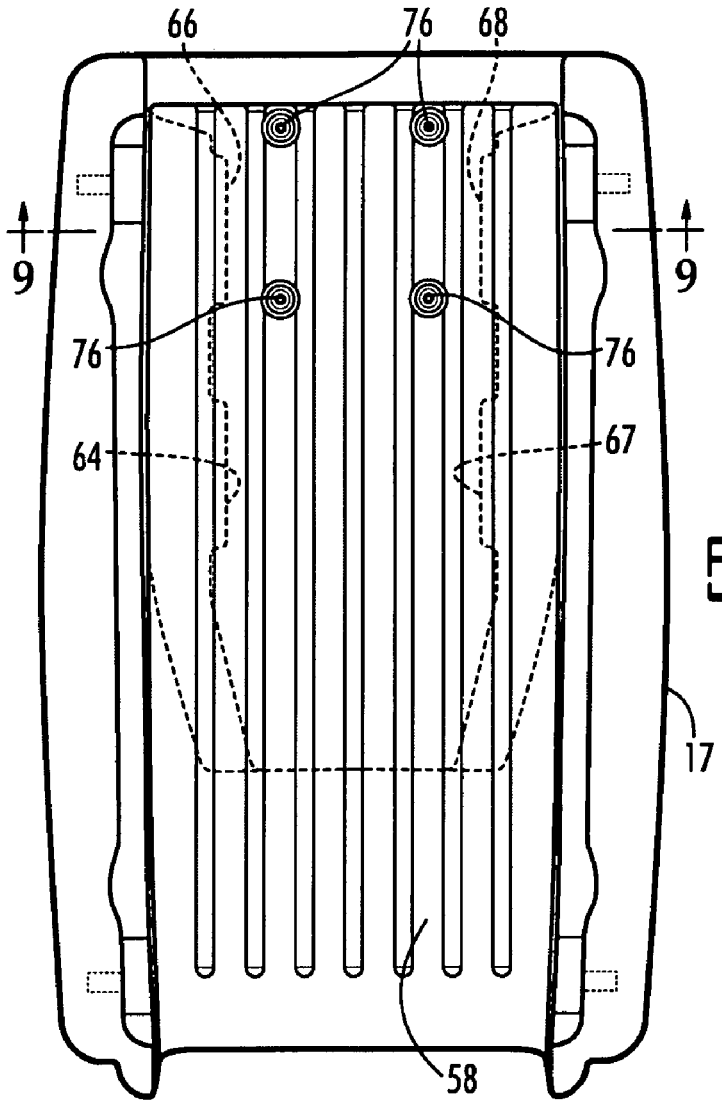
FIG. 5 is a top view of the newspaper box secured to the support.

Referring to FIGS. 2, 3 and 4, the tops of the pieces 21, 21 of the support 18 include tongues 51, 52 extending laterally outward in opposite directions above shoulders 53, 54 on the upper laterally outer corners of the pieces 21, 22. Referring also to FIGS. 5, 6, 7, 8 and 9, the newspaper box 17 has laterally spaced vertical sidewalls 56,57, a ridged floor 58 and a partial rear wall 59 extending upwardly at its rear end for stopping newspapers tossed into the newspaper box 17. The newspaper box 17 has a downwardly open cavity 61 on its under or bottom side which includes shoulders 62, 63 at the laterally opposite sides of the cavity 61 from which flanges 64, 65, 67, 68 extend laterally inward below the roof of the cavity 61 thereby providing laterally inward opening grooves 71, 72 which mate with the tongues 51, 52 when installed on the support 18 as illustrated in FIG. 9. Thus the grooves 71, 72 and the tongues 51, 52 releasably connect the newspaper box 17 to the two-piece support 18. The tongue and groove connection also serves to hold the upper ends of the pieces 21, 22 against lateral separation. The newspaper box 17 is also releasably secured to the pieces 21, 22 of the support 18 by four screws 76 extending downwardly through openings 77 in the floor 58 of the newspaper box 17 and into holes 78 in the pieces 21, 22.

What is claimed is:

1. A mailbox structure comprising:

a box having a pair of laterally spaced vertical side walls and a floor, said floor having a pair of laterally spaced parallel grooves on its underside opening inwardly toward one another and a vertical support having a pair of laterally spaced parallel tongues at its top, said tongues extending outwardly in opposite directions, said tongues being releasably engaged, respectively, in said pair of grooves and forming a pair of laterally spaced tongue and groove connections between said box and said support and wherein said vertical support includes a pair of vertically extending juxtaposed pieces with confronting sides, said sides having mating protrusions and pockets which are completely hidden from view when said pieces are joined together.

2. The mailbox structure of claim 1 wherein said pieces have confronting channels adapted for receiving a vertical support post.

3. The mailbox structure of claim 2 having releasable fastening means connecting said box to said support pieces.

4. The mailbox structure of claim 3 wherein said releasable fastenings means are a plurality of screws extending through openings in said floor and into said tops of said support pieces.

5. A mailbox structure comprising:

a support including a pair of vertical support pieces, said support pieces having laterally confronting sides with channels facing inwardly towards one another and adapted to receive a vertical post and tops with tongues extending laterally outward in opposite directions, a postal box, and a newspaper box beneath and in supporting relation to said postal box, said newspaper box having a front, a rear, laterally spaced side walls and a floor with a cavity on its under side including inwardly spaced grooves at laterally opposite sides of said cavity, said grooves opening inwardly toward one another, said tongues and grooves engaging one another to form a releasable tongue and groove connection between said newspaper box and said support pieces.

6. The mailbox structure of claim 5 having releasable fastening means connecting said newspaper box to said support pieces.

7. The mailbox structure of claim 6 wherein said releasable fastenings means are a plurality of screws extending through openings in said floor and into said tops of said support pieces.

8. The mailbox structure of claim 5 wherein said vertical support pieces include protrusions and pockets in said confronting sides which mate when said pieces are placed on opposite sides of the vertical post fitting within said channels.

* * * * *